United States Patent [19]

Yamazaki

[11] 4,325,719

[45] Apr. 20, 1982

[54] PROCESS FOR RECOVERING NITROGEN UNDER PRESSURE IN AIR SEPARATION APPARATUS

[75] Inventor: Masahiro Yamazaki, Kudamatsu, Japan

[73] Assignee: Hitachi, Ltd., Tokyo, Japan

[21] Appl. No.: 188,097

[22] Filed: Sep. 17, 1980

[30] Foreign Application Priority Data

Sep. 19, 1979 [JP] Japan ..... 54-119424

[51] Int. Cl.[3] ..... F25J 3/04

[52] U.S. Cl. ..... 62/30; 62/29

[58] Field of Search ..... 62/13–15, 62/29, 30

[56] References Cited

U.S. PATENT DOCUMENTS

| | | | |
|---|---|---|---|
| 2,673,456 | 3/1954 | Scharmann | 62/29 |
| 3,267,684 | 8/1966 | Jakob | 62/29 |
| 4,091,633 | 5/1978 | Linde | 62/29 |

*Primary Examiner*—Norman Yudkoff

*Attorney, Agent, or Firm*—Craig and Antonelli

[57] ABSTRACT

In an air separation apparatus for separating air by cryogenic process, thereby recovering oxygen and nitrogen, pressure of nitrogen gas withdrawn from an upper column of duplex type rectification tower is increased through an ejector utilizing liquid nitrogen to be introduced into the upper column as a reflux from lower column of duplex type rectification tower, and then the nitrogen gas is separated from the liquid nitrogen, and recovered under a desired pressure, while supplying the liquid nitrogen to the upper column. Product nitrogen is recovered under high pressure.

2 Claims, 3 Drawing Figures

PROCESS FOR RECOVERING NITROGEN UNDER PRESSURE IN AIR SEPARATION APPARATUS

BACKGROUND OF THE INVENTION

The present invention relates to a process for recovering a nitrogen gas under a desired higher pressure than the pressure of a nitrogen gas withdrawn from an upper column of a duplex type rectification tower in an air separation apparatus.

A flow diagram of an air separation apparatus according to the conventional cryogenic separation process is shown. Raw material air is supplied to a heat exchanger 5 from a pipe 101, cooled by a low temperature return gas therein, and injected into a lower column 1 of duplex type rectification tower through a pipe 102. The raw material air is distilled therein and separated into pure nitrogen, impure nitrogen and liquid air rich in oxygen. The pure nitrogen is withdrawn from the lower column 1 and led to an upper column 3 through a pipe 109, an expansion valve 12 and a pipe 110 for use in the upper column 3 of duplex-type rectification tower as a reflux. The impure nitrogen is also withdrawn from the lower column 1 and led to the upper column 3 through a pipe 107, an expansion valve 11 and a pipe 108 for use in the upper column 3 as a reflux. The liquid air is supplied to the upper column 3 from the lower column 1 through a pipe 105, an expansion valve 10 and a pipe 106. On the other hand, a portion of the raw material air is withdrawn from the heat exchanger 5 at an intermediate position to compensate a coldness of the entire air separation apparatus, led to an expansion turbine 4 through a pipe 103, adiabatically expanded therein to generate coldness, and injected into the upper column 3 through a pipe 104. From the upper column 3 are withdrawn pure oxygen through a pipe 111, impure nitrogen through a pipe 113 and pure nitrogen through a pipe 115. They are individually heated in the heat exchanger 5 in heat exchange with the incoming raw material air, and pure oxygen is withdrawn through a pipe 112, impure nitrogen through a pipe 114 and pure nitrogen through a pipe 116.

The nitrogen gas withdrawn from the upper column 3 is under a pressure of about 200 mmAq at the outlet of the heat exchanger 5 owing to the pressure loss in the upper column 3. Thus, when the pressure of nitrogen is increased to about 1,000 mmAq in the apparatus of FIG. 1, the pressure of nitrogen in the lower column 1 must be increased to maintain the necessary temperatures of oxygen in the upper column 3 and nitrogen in the lower column 1 through a main condenser 2, and consequently the pressure of raw material must be increased. That is, a power for compressing the raw material air must be increased, and this is not economical.

SUMMARY OF THE INVENTION

An object of the present invention is to provide an air separation apparatus capable of recovering nitrogen under a pressure of about 1,000 mmAq from the upper column of duplex type rectification tower without increasing a power for compressing the raw material air.

According to the present invention, nitrogen under a pressure of about 1,000 mmAq can be recovered by increasing the pressure of a nitrogen gas under a low pressure by an injector, utilizing reflux liquid nitrogen.

PREFERRED EMBODIMENTS OF THE INVENTION

Embodiments of the present invention will be described in detail below, referring to FIGS. 2 and 3.

Figure 2:
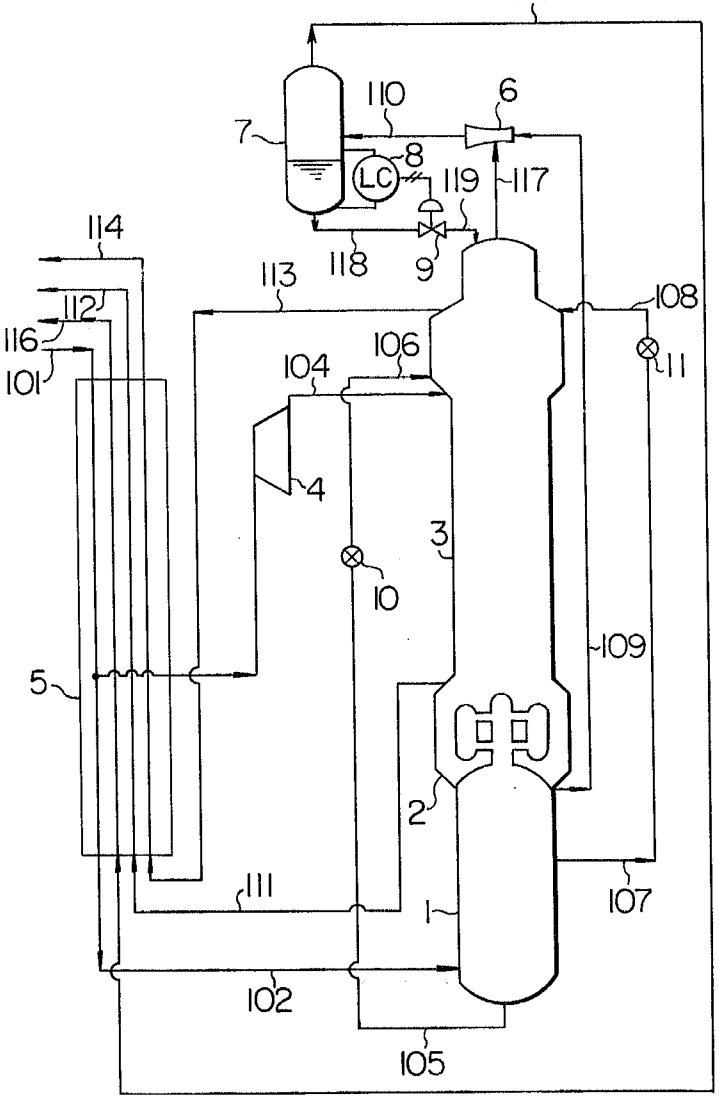
FIGS. 2 and 3 are flow diagrams of air separation apparatuses showing embodiments of the present invention.

According to an embodiment of FIG. 2, pure nitrogen under a low pressure is withdrawn from the upper column 3 at the top through a pipe 117 by suction through an ejector 6. The suction force of ejector 6 is given by pure liquid nitrogen supplied from the lower column 1 through the pipe 109. The liquid nitrogen and withdrawn nitrogen gas leaving the ejector 6 enter a nitrogen separator 7 through a pipe 110. The nitrogen gas under the increased pressure is withdrawn under a pressure of about 1,000 mmAq to the outside of the air separation apparatus through a pipe 115, the heat exchanger 5 and the pipe 116. On the other hand, the flow rate of liquid nitrogen from the nitrogen separator 7 is adjusted so as to keep the liquid nitrogen to a constant liquid level in the nitrogen separator 7 by a liquid level controller 8, and the liquid nitrogen is supplied to the upper column 3 through a pipe 118, a control valve 9 and a pipe 119.

Figure 3:
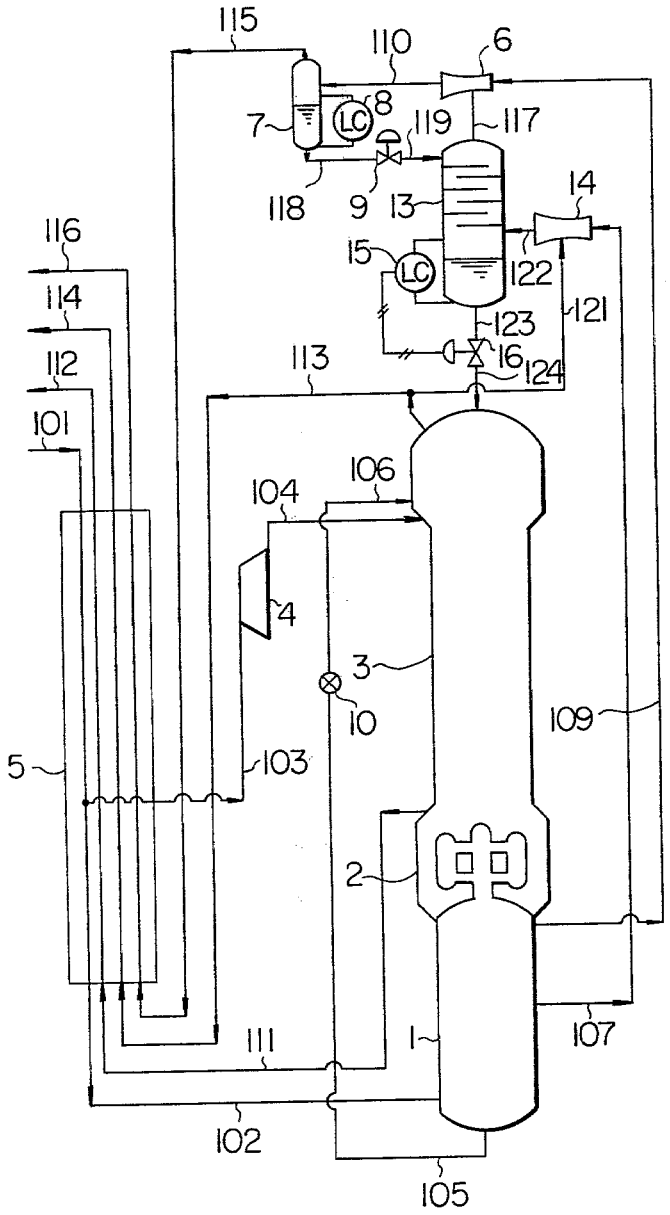

In FIG. 3, another embodiment of withdrawing nitrogen under a higher pressure, utilizing two ejectors, is given. The pressure of the resulting nitrogen is 2,000 mmAq or higher.

According to the embodiment of FIG. 3, a nitrogen column 13 is further provided, and impure nitrogen under a low pressure is withdrawn from the upper column 3 through a pipe 121 by suction through an ejector 14. The suction force of the ejector 14 is given by impure liquid nitrogen supplied from the lower column 1 through the pipe 107. The impure liquid nitrogen and the withdrawn impure nitrogen gas are led to the bottom of the nitrogen column 13 through a pipe 122. The nitrogen column 13 is operated under a pressure of about 3,000 mmAq and the impure nitrogen is washed by pure nitrogen supplied to the nitrogen column 13 through the pipe 119, and turns a pure nitrogen gas, which is withdrawn by the ejector 6 through the pipe 117 and the pressure of the pure nitrogen gas is further increased thereby. The succeeding process of the pure nitrogen gas and the liquid pure nitrogen used as the suction force for the ejector 6 is the same as in FIG. 2. The pure nitrogen gas is withdrawn to the outside of the air separation apparatus through the pipe 116 and recovered as a product nitrogen gas under a pressure of about 2,000 mmAq. On the other hand, the flow rate of the impure liquid nitrogen from the nitrogen column 13 is adjusted so as to keep the impure liquid nitrogen at the bottom of the nitrogen column 13 at a constant liquid level by a liquid level controller 15. The impure liquid nitrogen is supplied to the upper column 3 through a pipe 123, a control valve 16 and a pipe 124.

Figure 1:
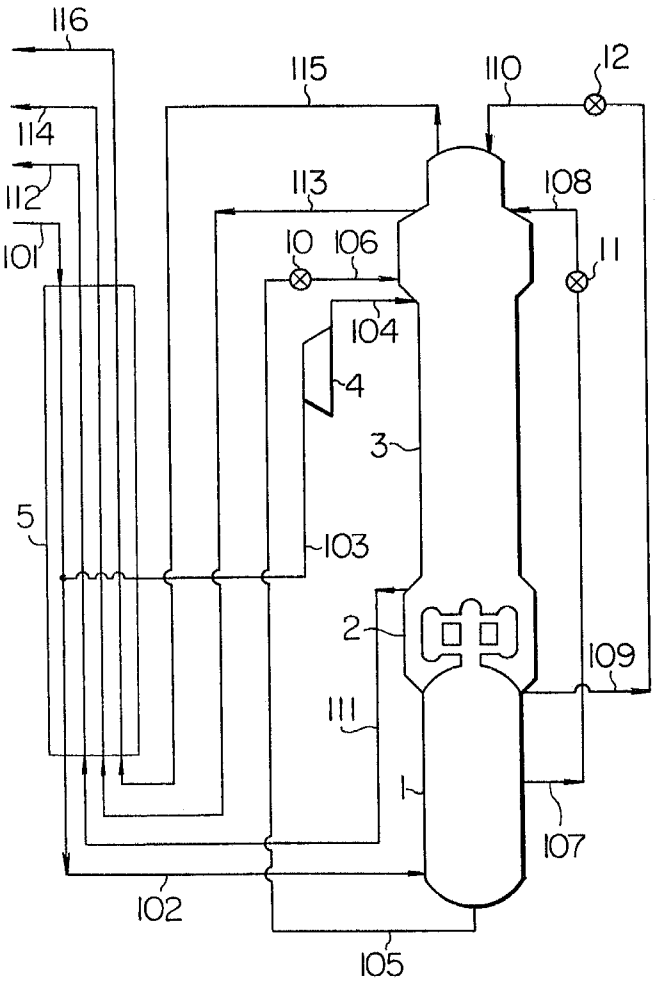
FIG. 1 is a flow diagram of an air separation apparatus according to the conventional cryogenic separation process.

As described above, the pressure of product nitrogen can be increased according to the present invention, and thus, when nitrogen is compressed by a compressor, not only the power of nitrogen compressor can be reduced, but also the size of a nitrogen compressor can be reduced. For example, in the case of compressing nitrogen to a pressure of 7 kg/cm$^2$ gage, power and size can be reduced to 96% and 91%, respectively, according to the embodiment of FIG. 2, and 92% and 84%, respectively, according to the embodiment of FIG. 3, when the power and size of a nitrogen compressor are presumed to be 100, respectively according to the conventional flow of FIG. 1. Thus, the present invention is considerably effective for both equipment cost and power consumption.

What is claimed is:

1. In a process fo recovering nitrogen under pressure in an air separation apparatus comprising a duplex type rectification tower having a lower column and an upper column, wherein air is separated into oxygen and nitrogen by a cryogenic process, and the separated oxygen and nitrogen are recovered, the improvement which comprises increasing the pressure of the pure nitrogen gas withdrawn from the upper column by withdrawing the pure nitrogen gas by an ejector receiving pure liquid nitrogen directly from the top of the lower column, introducing the resulting gas-liquid mixture into a liquid gas-separator unit, recovering pure nitrogen gas at the increased pressure by liquid-gas separation in the separator unit, and returning liquid nitrogen from the separator unit to the upper column as a reflux.

2. In a process for recovering nitrogen under pressure in an air separation apparatus comprising a duplex type rectification tower having a lower column and an upper column, wherein air is separated into oxygen and nitrogen by a cryogenic process, and the separated oxygen and nitrogen are recovered, the improvement which comprises increasing the pressure of impure nitrogen gas withdrawn from the upper column by withdrawing the impure nitrogen gas through an ejector receiving impure liquid nitrogen directly from the middle level of the lower column and at the pressure of the lower column, supplying the impure nitrogen gas together with the impure liquid nitrogen from the ejector to a nitrogen column, washing the impure nitrogen gas in said column with pure liquid nitrogen, supplying the impure liquid nitrogen to the upper column from the nitrogen column, while further increasing the pressure of the pure nitrogen gas withdrawn from the nitrogen column by an ejector receiving pure liquid nitrogen directly from the top of the lower column and at the pressure of the lower column, introducing the resulting gas-liquid mixture of pure nitrogen into a liquid-gas separator unit, recovering pure nitrogen gas at an increased pressure by gas-liquid separation in said separator unit, and returning liquid nitrogen from the separator unit to the nitrogen column as a reflux.

* * * * *